US011761165B1

(12) United States Patent
Stadler

(10) Patent No.: US 11,761,165 B1
(45) Date of Patent: Sep. 19, 2023

(54) MANHOLE COVER

(71) Applicant: David M. Stadler, Lathrup Village, MI (US)

(72) Inventor: David M. Stadler, Lathrup Village, MI (US)

(73) Assignees: David M. Stadler, Lathrup Village, MI (US); Joan M. Stadler, Lathrup Village, MI (US)

( * ) Notice: Subject to any disclaimer, the term of this patent is extended or adjusted under 35 U.S.C. 154(b) by 0 days.

(21) Appl. No.: 18/114,903

(22) Filed: Feb. 27, 2023

(51) Int. Cl.
*E02D 29/14* (2006.01)

(52) U.S. Cl.
CPC ..... *E02D 29/1427* (2013.01); *E02D 29/1436* (2013.01)

(58) Field of Classification Search
None
See application file for complete search history.

(56) References Cited

U.S. PATENT DOCUMENTS 822,562 A 6/1906 Tucker
858,781 A * 7/1907 Benedict ..... B60K 15/0409 114/174
1,788,118 A 1/1931 Meyer
2,025,839 A 12/1935 Woods, Jr.
2,363,567 A 11/1944 Blakeman
2,608,085 A * 8/1952 Castle ..... E05C 1/14 292/173
3,201,161 A * 8/1965 Castle ..... E05C 1/145 292/173
3,530,696 A 9/1970 Dunmire
3,772,828 A 11/1973 Chahley
3,921,494 A 11/1975 Coe
4,101,154 A 7/1978 Kagstrom
4,461,597 A 7/1984 Laurin
4,902,165 A 2/1990 Embree
4,964,755 A 10/1990 Lewis
5,062,735 A 11/1991 Gaudin
5,082,392 A 1/1992 Marchese et al.
5,312,202 A 5/1994 Newton
(Continued)

FOREIGN PATENT DOCUMENTS

AU 2013203172 5/2013
EP 2363555 A1 * 9/2011 ..... E02D 29/14
(Continued)

*Primary Examiner* — Thomas B Will
*Assistant Examiner* — Katherine J Chu
(74) *Attorney, Agent, or Firm* — SIMONELLI IP, PLLC

(57) ABSTRACT

A manhole assembly includes a manhole cover and a manhole frame. The manhole cover is received on the manhole frame. A latch bolt attached to the manhole cover is movable between a latched position and a removal position. The latch bolt is biased toward the latched position by a spring. A security bolt received in the manhole cover is movable between a locked position wherein the security bolt engages the latch bolt to lock the latch bolt in the latched position and a removal position wherein the security bolt is disengaged from the latch bolt. An extraction tool is inserted through the manhole cover to remove the manhole cover from the manhole frame. The extraction tool engages a driven cam surface on the latch bolt to drive the latch bolt against a biasing force of the spring to move the latch bolt to the removal position.

20 Claims, 4 Drawing Sheets

(56) References Cited

U.S. PATENT DOCUMENTS

| | | | | |
|---|---|---|---|---|
| 5,324,135 | A | 6/1994 | Smith | |
| 5,533,641 | A * | 7/1996 | Argandona | B65D 90/105 220/248 |
| 5,845,442 | A | 12/1998 | Strehlow | |
| 5,987,824 | A | 11/1999 | Fuller | |
| 6,350,081 | B1 | 2/2002 | Khajavi et al. | |
| 6,551,015 | B1 | 4/2003 | Khajavi et al. | |
| 6,676,332 | B1 | 1/2004 | Hauer et al. | |
| 6,735,992 | B2 | 5/2004 | Hauer et al. | |
| 6,739,796 | B1 | 5/2004 | Del Nero et al. | |
| 6,764,261 | B1 | 7/2004 | Stadler | |
| 7,171,994 | B1 | 2/2007 | O'Brien | |
| 7,201,533 | B2 | 4/2007 | Degreef | |
| 7,243,515 | B2 | 7/2007 | Meyer | |
| 7,347,070 | B1 | 3/2008 | Spector | |
| 7,484,908 | B2 | 2/2009 | Stadler | |
| 7,748,927 | B2 | 7/2010 | Neathery | |
| 8,132,436 | B2 * | 3/2012 | Dutilleul | E02D 29/1409 70/427 |
| 8,784,000 | B2 | 7/2014 | Reynolds et al. | |
| 8,794,865 | B2 | 8/2014 | Stadler | |
| 9,004,810 | B2 | 4/2015 | Reynolds et al. | |
| 10,704,221 | B2 * | 7/2020 | Nolle | E02D 29/1427 |
| 2004/0244444 | A1 | 12/2004 | Wadsworth | |
| 2013/0221688 | A1 | 8/2013 | Stadler | |
| 2019/0345740 | A1 * | 11/2019 | Fisher | E05B 65/52 |
| 2023/0049236 | A1 * | 2/2023 | Hubbard | E02D 29/127 |

FOREIGN PATENT DOCUMENTS

| | | |
|---|---|---|
| EP | 2685009 | 11/2014 |
| WO | 2004/018787 | 3/2004 |

* cited by examiner

MANHOLE COVER

TECHNICAL FIELD

This disclosure relates to manhole covers that are responsive to pressure applied below the manhole cover by a gas explosion or flooding.

BACKGROUND

This invention concerns manhole covers and more particularly latching systems for manhole covers which may be locked to prevent removal by unauthorized persons, but which may selectively be unlocked to allow removal by an authorized person when necessary (see U.S. Pat. No. 6,764,261.

The present inventor has also previously developed manhole latching systems which allow relief of gas pressures developed in a covered vault in case of an explosion to prevent damage to the vault while preventing launching of the manhole cover into the air entirely free of the frame, U.S. Pat. Nos. 7,484,908 and 7,712,995 include a description of such a manhole locking system.

In an explosion of flammable gases, the vault chamber, which is covered by a manhole cover, the cover described therein is allowed to rise off the frame to a limited extent due to a clearance between latching lugs and a frame stop feature which is forcefully contacted by the lugs in an explosion driving the manhole cover up against the stop.

This forcible contact causes severe stress due to the great upward speed of a cover blown up by an explosion in the vault chamber. This stress creates a potential failure of the lug with the possibility that the cover can be blown free of the frame, presenting a safety hazard from the flying cover and the subsequent absence of a cover over the vault chamber.

Another disadvantage of selectively releasable latching systems controlling removal of the cover is the significant costs involved in adding the latching components to manhole covers Vault chamber explosions are of varying severity, and it would be advantageous to minimize the height the cover moves up in safely dissipating the explosion induced stresses. That is, it would reduce the hazards to passing traffic if the height the cover reaches for an explosion of lesser severity were reduced.

Flooding of the chamber with water can similarly create a need for allowing the cover to rise off its seat in the frame while preventing the manhole cover from being washed completely free of the frame.

This disclosure is directed to solving the above problems and other problems as summarized below.

SUMMARY

According to one aspect of this disclosure, manhole assembly apparatus that includes a manhole cover and a manhole frame. The manhole cover is adapted to be received on the manhole frame. A latch bolt attached to the manhole cover is movable between a latched position and a removal position. The latch bolt is biased toward the latched position by a spring. A security bolt received in the manhole cover is movable between a locked position wherein the security bolt engages the latch bolt to lock the latch bolt in the latched position and a removal position wherein the security bolt is disengaged from the latch bolt. The manhole cover is configured to receive an extraction tool that is inserted through the manhole cover to remove the manhole cover. The extraction tool engages a driven cam surface on the latch bolt to drive the latch bolt against a biasing force of the spring to move the latch bolt to the removal position.

According to another aspect of this disclosure, an apparatus is disclosed that comprises a manhole cover having at least one lug that is received in the manhole opening and a latch bolt. The latch bolt is received in a first bore defined by the manhole cover that extends horizontally from a periphery of the manhole cover toward a center thereof, the latch bolt is movable between a latched position and a removal position. In the latched position, a protrusion of the latch bolt extends radially outwardly from the periphery to a location spaced from and below the manhole frame. A spring disposed in the first bore biases the latch bolt toward the latched position. A security bolt received in a second bore defined by the manhole cover extends substantially vertically through the manhole cover. The security bolt is received in an opening defined by the latch bolt to lock the latch bolt in the locked position. A third bore defined by the manhole cover extends from a top surface of the manhole cover at a substantially acute angle of about 45 degrees from the top surface to the second bore. The latch bolt defines a recess having a cam surface at an intermediate location on the latch bolt that is configured to be engaged by a distal end of an extraction tool, wherein the extraction tool engages the cam surface to move the latch bolt toward the spring when the security bolt is removed from the opening defined by the latch bolt.

According to other aspects and alternatives to the above aspects of this disclosure, this disclosure may include additional optional features as described below.

The latch bolt may be spaced below the manhole frame in the latched position, wherein when a fluid applies pressure to a lower surface of the manhole cover sufficient to lift the manhole relative to the manhole frame, a space is created between a periphery of the manhole cover and the manhole frame that vents the fluid.

The fluid may be an expanding gas created by a first explosion, and wherein the manhole cover drops back onto the manhole frame after the expanding gas is vented to prevent a second explosion caused by air flowing back under the manhole cover into a vacuum created by the first explosion.

The latch bolt may define a guide slot adjacent a hole in a top surface of the latch bolt that guides movement of the latch bolt between the latched position and the removal position and prevents rotation of the latch bolt.

The apparatus may further comprise an extraction tool including an elongated shaft, a handle on an upper end, and a drive cam surface on a lower end.

The apparatus may further include a twist lock mechanism locks the extraction tool to the manhole cover when fully inserted into a bore defined by the manhole cover and the latch bolt is in the removal position. The twist lock mechanism may include a plate provided on an intermediate portion of a shaft portion of the extraction tool, wherein the plate is inserted into at least one slot defined by the manhole cover, wherein the slot extends parallel to a length dimension of the shaft portion, wherein the slot extends from the top surface of the manhole cover to a seat that is defined by an annular slot formed in the manhole cover, and wherein the plate is inserted by the extraction tool in the slot until the plate reaches the annular slot where the plate is rotated into the annular slot to lock the latch bolt in the removal position. The extraction tool when locked to the manhole cover may be used to lift the manhole cover off the manhole frame.

The apparatus may further comprise a debris cap attached over an access hole defined by the manhole cover, wherein the access hole provides access to the security bolt and a hole configured to receive the extraction tool.

The security bolt is adapted to be turned by a tool inserted through the second bore.

The above aspects of this disclosure and other aspects will be described below with reference to the attached drawings.

DETAILED DESCRIPTION

Figure 1:
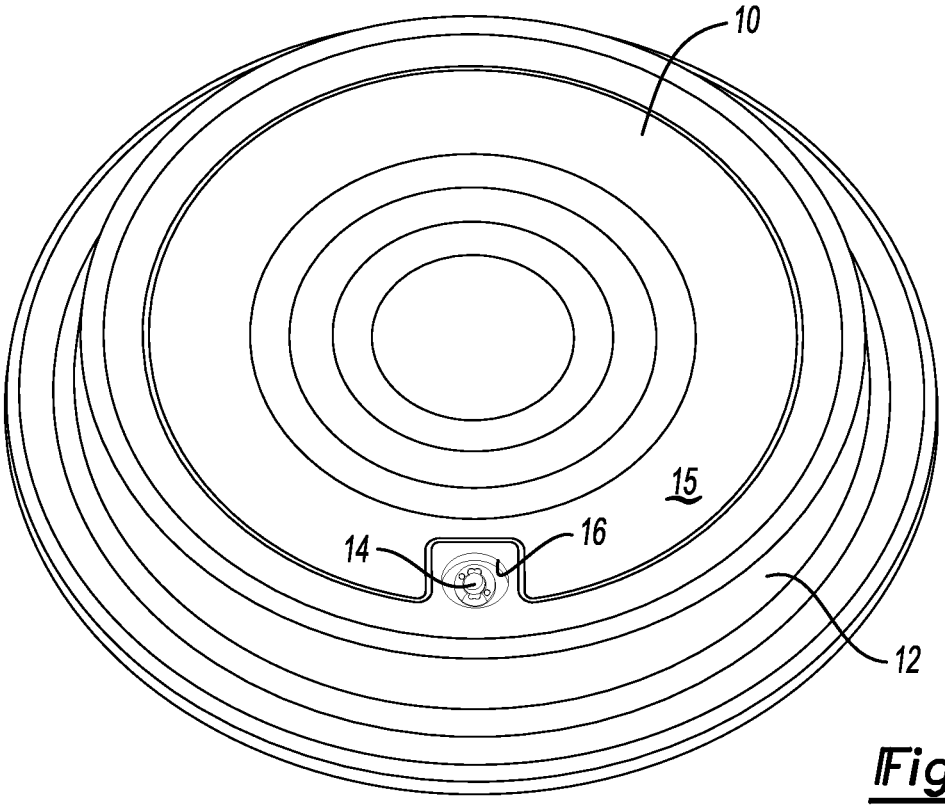
FIG. 1 is a top side perspective view of a manhole cover made according to one aspect of this disclosure installed on a manhole frame.

The illustrated embodiments are disclosed with reference to the drawings. However, it is to be understood that the disclosed embodiments are intended to be merely examples that may be embodied in various and alternative forms. The figures are not necessarily to scale, and some features may be exaggerated or minimized to show details of particular components. The specific structural and functional details disclosed are not to be interpreted as limiting, but as a representative basis for teaching one skilled in the art how to practice the disclosed concepts.

Various features illustrated and described with reference to any one of the figures may be combined with features illustrated in one or more of the other figures to produce embodiments that are not explicitly illustrated or described. The combinations of features illustrated provide representative embodiments for typical applications. Various combinations and modifications of the features consistent with the teachings of this disclosure could be used in particular applications or implementations.

"One or more" includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof."

"As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context."

Referring to FIG. 1, a manhole cover 10 is illustrated on a manhole frame 12. A debris cap 14 is attached to a top surface 15 of the manhole cover 10 over an access hole 16 defined by the manhole cover 10. The manhole cover 10 is automatically seated within the manhole frame 12 as will be explained further below.

Figure 2:
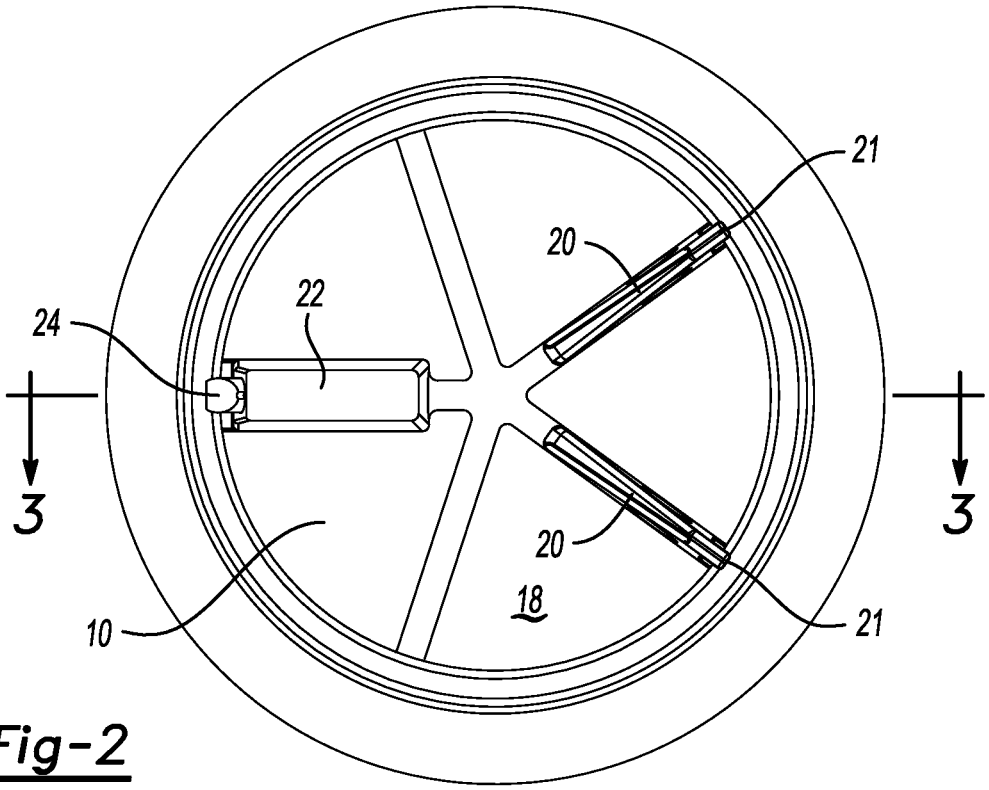
FIG. 2 is a bottom plan view of a manhole cover made according to one aspect of this disclosure installed on a manhole frame.

Referring to FIG. 2, a lower surface 18 of the manhole cover 10 is illustrated. Two lugs 20 are provided on the lower surface 18 that are fixed relative to the manhole cover 10 and each lug 20 includes a tang 21 that is spaced below the manhole frame 12 when the manhole cover 10 is installed on the manhole frame 12. The spacing between the tang 21 and the manhole frame 12 allows the manhole cover 10 to be raised off the manhole frame 12 to vent gases from an explosion below the manhole cover 10 or port flood water from below the manhole cover 10.

A latch assembly 22 is assembled to the lower surface 18 of the manhole cover 10. The latch assembly 22 includes a projection 24 that extends to a location below and spaced from the manhole frame 12. The spacing between the projection 24 and the manhole frame 12 allows the manhole cover 10 to be raised off the manhole frame 12 to also vent gases from an explosion below the manhole cover 10 or port flood water from below the manhole cover 10.

When the manhole cover 10 is installed on the manhole frame 12, the latch assembly 22 includes a latch bolt 26 that automatically retracts as it passes the manhole frame 12 and is extended again when below the manhole frame 12.

Figure 3:
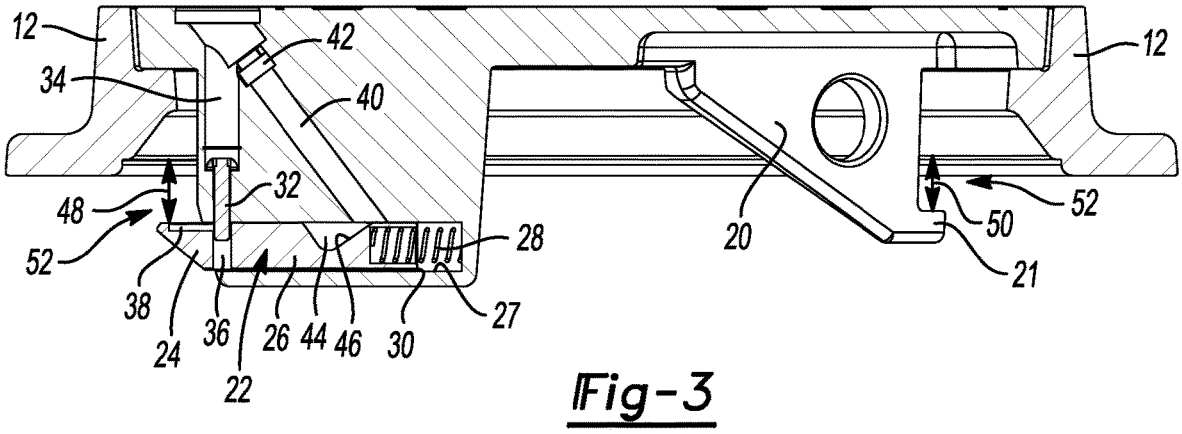
FIG. 3 is a cross section view taken along the line 3-3 in FIG. 2 showing the manhole cover in the latched position.
Figure 4:
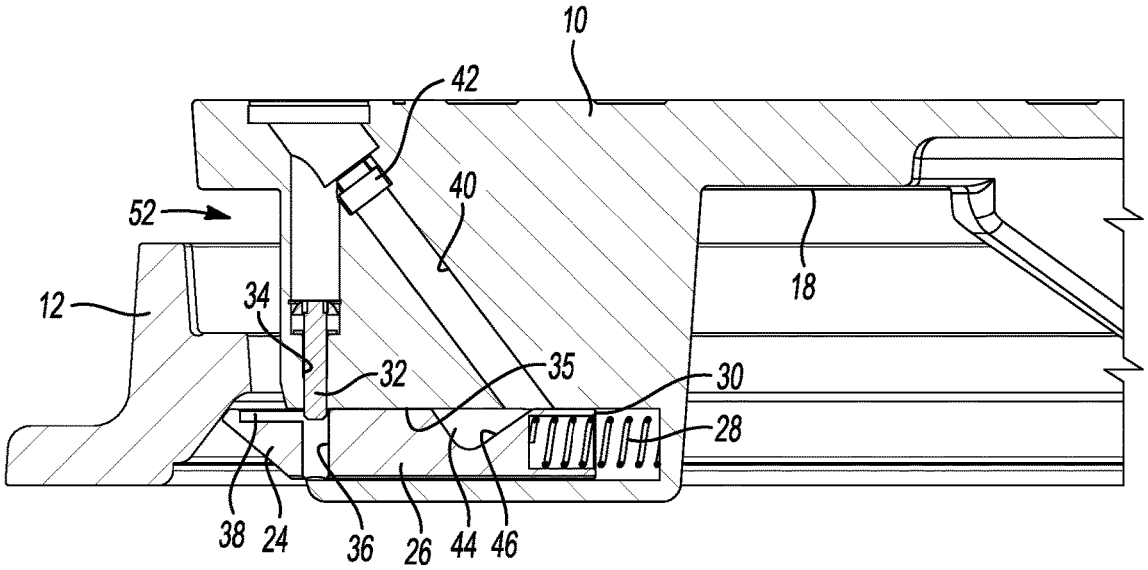
FIG. 4 is a cross section view similar to FIG. 3 showing the manhole cover lifted off the manhole frame in response to pressure being applied to the bottom surface of the manhole cover.

Referring to FIGS. 3 and 4, cross-section views are provided to illustrate operation of the latch assembly 22. The latch assembly 22 includes the latch bolt 26 disposed in a horizontal bore 27, also referred to as a first bore, that is biased radially outwardly by a spring 28 at an internal end 30 of the latch bolt 26. The spring 28 is compressed when the latch bolt 26 is retracted. A security bolt 32 is received in a vertical bore 34, that is also referred to as a second bore, and a hole 36 provided in the latch bolt 26. A guide slot 38 is open to the hole 36 in a top surface 35 of the latch bolt 26. The security bolt 32 is provided with threads that cooperate with threads in the vertical bore 34 to advance the security bolt 32 into the hole 36 to lock the latch bolt 26. The security bolt 32 is withdrawn from the hole 36 to release the latch bolt 26 with the security bolt 32 extending from the vertical bore 34 to the depth of the guide slot 38.

Another bore 40, also referred to as a third bore, is formed in the manhole cover 10 at substantially at or about a 45-degree angle relative to the top surface of the manhole cover 10. The bore 40 extends radially inwardly and downwardly from the top surface 15. As used herein, substantially 45 degrees should be understood to be between 30 and 60 degrees relative to the top surface of the manhole cover 10.

A twist lock mechanism 42 is provided in the bore 40. A recess 44 is defined by the latch bolt 26. The recess 44 includes a driven cam surface 46. A first gap 48 is defined between the projection 24 and the manhole frame 12. A second set of gaps 50 is provided between the tangs 21 of the lugs 20 and the manhole frame 12. The gaps 48 and 50 allow the manhole cover 10 to be raised off the manhole frame 12 to vent gases through a venting space 52 from an explosion below the manhole cover 10 or port flood water from below the manhole cover 10.

The manhole cover 10 is shown in its raised position in FIG. 4 because of pressure applied to the lower surface 18 of the manhole cover 10. The manhole cover 10 is lifted off the manhole frame 12 to vent pressure from below the manhole cover 10. The projection 24 of the latch bolt 26 is in an extended position and is held in place by the security bolt 32. The projection 24 may engage the manhole frame 12 if sufficient pressure is applied to the lower surface 18 of the manhole cover 10. When the pressure is released, the manhole cover 10 remains centered relative to the manhole frame 12 and returns to the latched position shown in FIG. 3 by the force of gravity.

Figure 5:
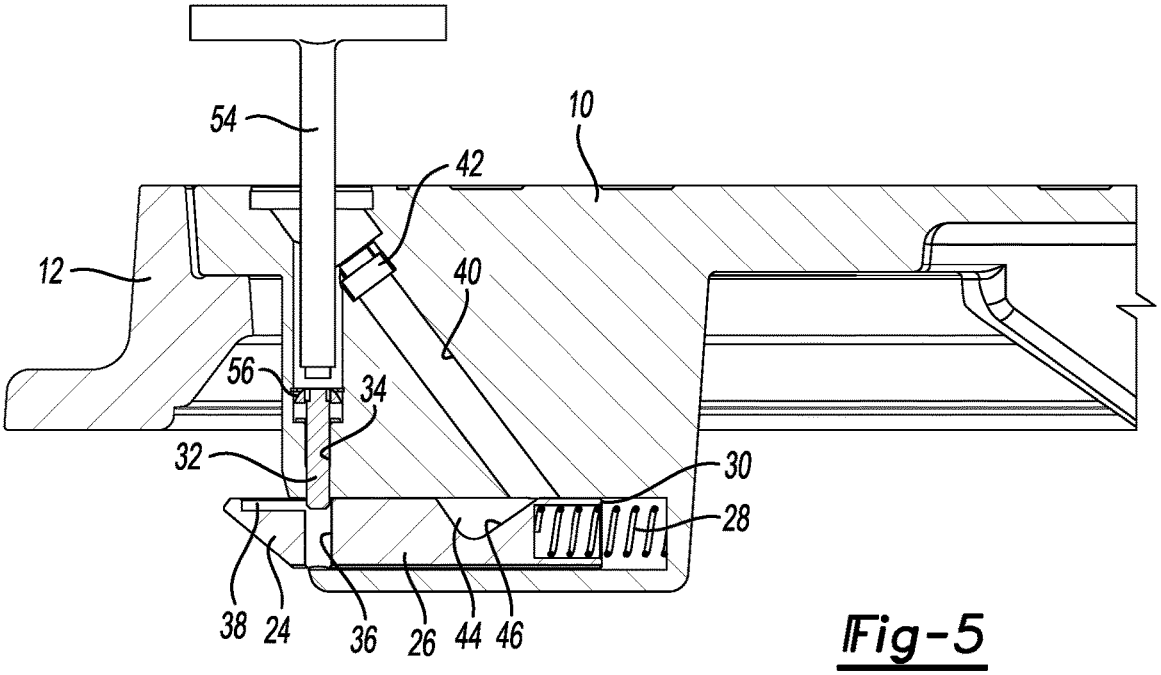
FIG. 5 is a partial cross section view taken along the line 3-3 in FIG. 2 showing the manhole cover with a security bolt removed from the hole in the latch bolt.

Referring to FIG. 5, a tool 54 is shown being inserted to engage the head of the security bolt 32. The tool 54 may be a screwdriver, a nut driver or the like, that engages the head 56 of the security bolt 32 to advance and withdraw the security bolt 32 from the latch bolt 26. When the security bolt 32 is received in the latch bolt 26, as shown in FIG. 3, the latch bolt is held with the projection 24 extending outboard of the manhole cover 10. When the security bolt 32 is withdrawn to the position shown in FIG. 4, the security bolt 32 may enter the guide slot 38 to guide movement of the latch bolt 26 as it is moved from a latched position to a removal position.

Figure 6:
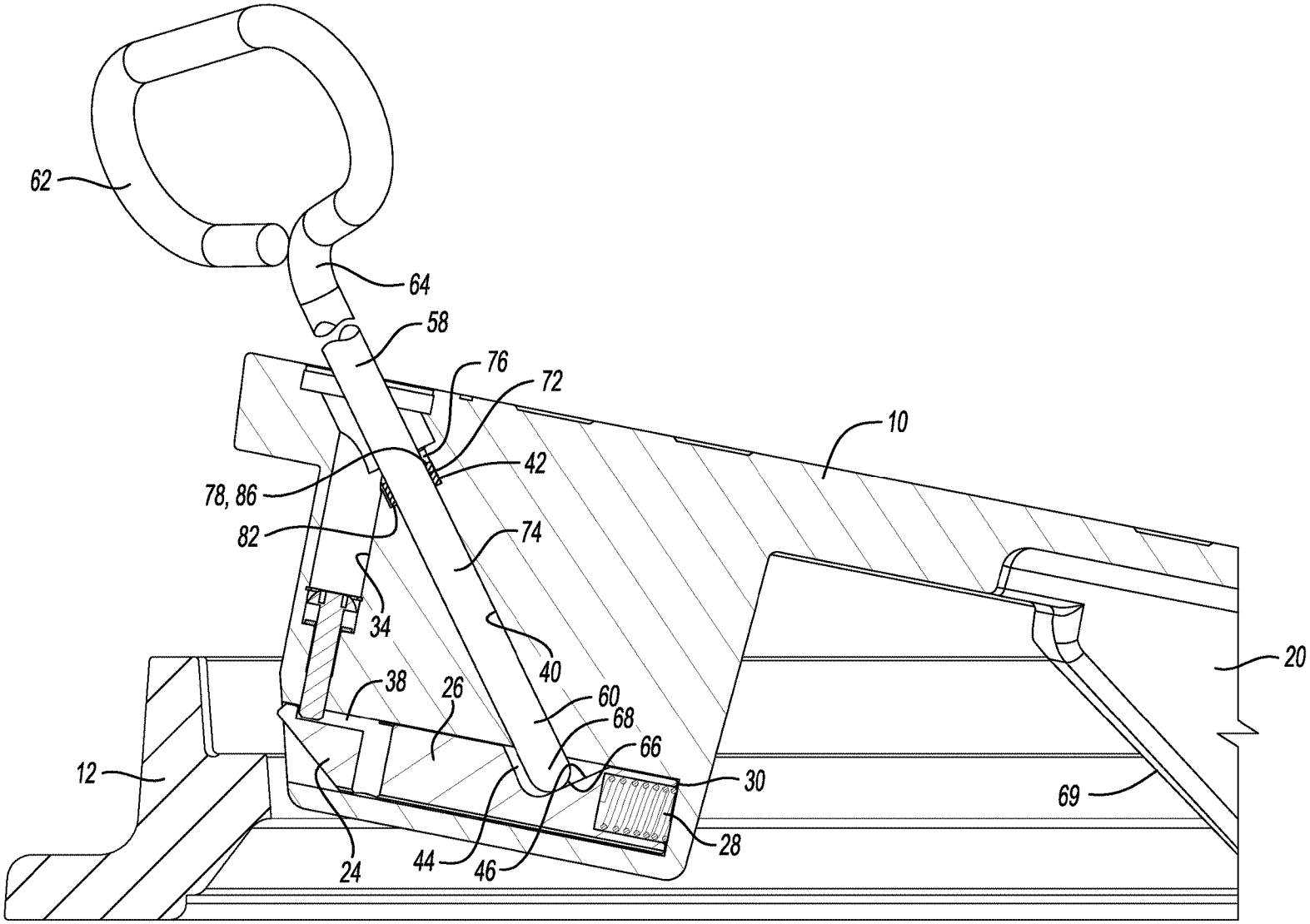
FIG. 6 is a partial cross section view taken along the line 3-3 in FIG. 2 showing the manhole cover with the security bolt removed from the hole in the latch bolt, an extraction tool inserted through a hole in the manhole cover and engaging a cam surface formed in a recess on the latch bolt to move the latch bolt against the biasing force of a spring and with the manhole cover being removed from the manhole frame.

Referring to FIG. 6, the manhole cover 10 is shown in the process of being removed from the manhole frame 12. An extraction tool 58 is shown to be inserted into the bore 40. The extraction tool 58 includes an elongated shaft portion 60 and a handle 62 at an upper end 64 of the elongated shaft 60. A drive cam surface 66 is provided at the lower end 68 of the elongated shaft 60.

The extraction tool 58 is inserted through the bore 40 to engage the driven cam 46 surface with the drive cam surface 66. The spring 28 is compressed by the latch bolt 26 as it is moved radially inwardly and the projection 24 moves to the removal position with the projection 24 clearing the manhole frame 12, allowing the manhole cover to be lifted off the manhole frame 12. The lugs 20 both include a ramp surface 69 on a lower surface that engages the manhole frame 12 when the manhole cover 10 slides across the manhole frame 12 and is removed.

Figure 7:
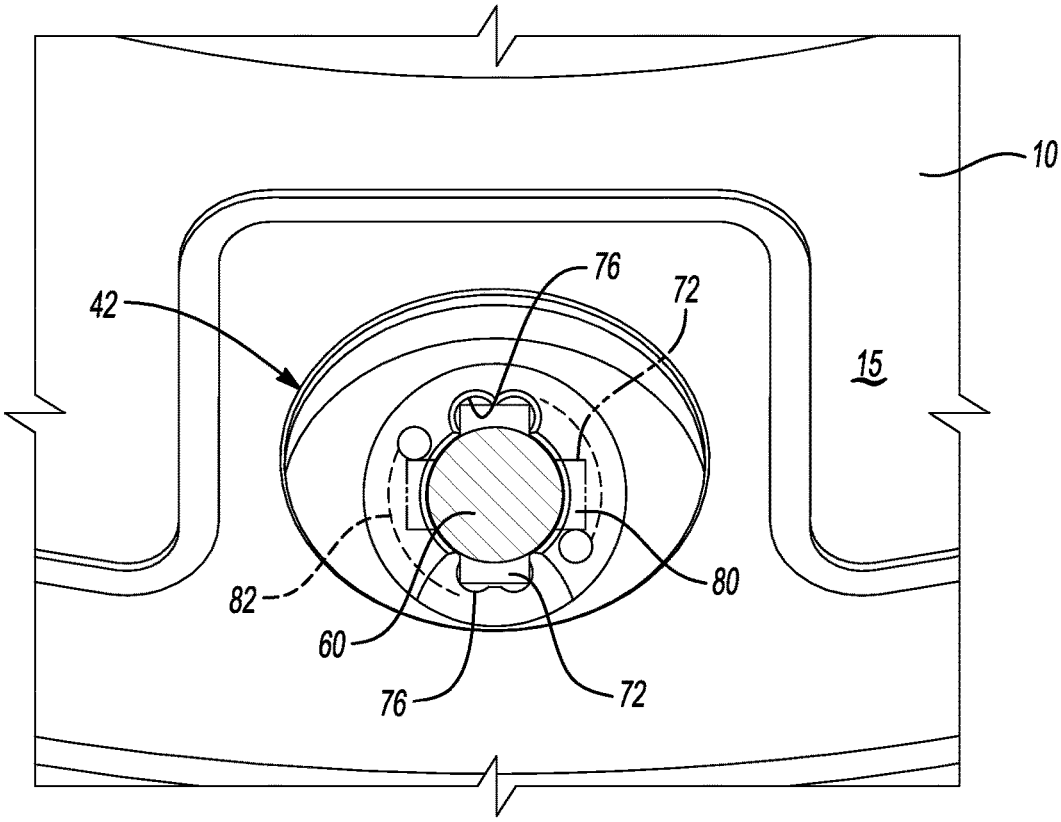
FIG. 7 is a fragmentary view of a manhole cover showing the twist lock of the extraction tool and the access hole provided in the manhole cover.

Referring to FIG. 7, the debris cap 14 is removed from the manhole cover 10 and the elongated shaft portion 60 of the extraction tool 58 is shown in cross-section. A plate 72 is attached to and part of the extraction tool 58, as shown in FIG. 6, on the elongated shaft 60. The plate 72 is shown to be in alignment with a slot 76 defined by the manhole cover 10 adjacent the bore 40. The plate 72 is inserted in the slot 76 to a depth wherein the latch bolt 26 is driven to compress the spring 28. As shown in FIG. 6, the plate 72 is recessed below a top surface 15 of the manhole cover 10. An annular slot 82 receives the plate 72 of the extraction tool 58 and is retained in the bore 40 when the plate 72 is rotated to the position shown in dashed lines in FIG. 6.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An apparatus, comprising:

a manhole cover adapted to be received on a manhole frame;

a latch bolt attached to the manhole cover that is movable between a latched position and a removal position, the latch bolt being biased toward the latched position by a spring; and a security bolt received in the manhole cover that is movable between a locked position wherein the security bolt engages the latch bolt to lock the latch bolt in the latched position and a removal position wherein the security bolt is disengaged from the latch bolt, wherein the manhole cover is configured to receive an extraction tool that is inserted through the manhole cover to remove the manhole cover, and wherein the extraction tool engages a driven cam surface on the latch bolt to drive the latch bolt against a biasing force of the spring to move the latch bolt to the removal position.

2. The apparatus of claim 1 wherein the latch bolt is spaced below the manhole frame in the latched position, wherein when a fluid applies pressure to a lower surface of the manhole cover sufficient to lift the manhole relative to the manhole frame, a space is created between a periphery of the manhole cover and the manhole frame that vents the fluid.

3. The apparatus of claim 2 wherein the fluid is an expanding gas created by a first explosion, and wherein the manhole cover drops back onto the manhole frame after the expanding gas is vented to prevent a second explosion caused by air flowing back under the manhole cover into a vacuum created by the first explosion.

4. The apparatus of claim 1 wherein the security bolt is received in a substantially vertical bore defined by the manhole cover and a hole defined by the latch bolt.

5. The apparatus of claim 4 wherein the latch bolt defines a guide slot adjacent the hole in a top surface of the latch bolt that guides movement of the latch bolt between the latched position and the removal position and prevents rotation of the latch bolt.

6. The apparatus of claim 1, further comprising:

an extraction tool including an elongated shaft, a handle on an upper end, and a drive cam surface on a lower end.

7. The apparatus of claim 6 wherein a twist lock mechanism locks the extraction tool to the manhole cover when fully inserted into a bore defined by the manhole cover and the latch bolt is in the removal position.

8. The apparatus of claim 7 wherein the twist lock mechanism includes a plate provided on a shaft portion of the extraction tool, wherein the plate is inserted into at least one slot defined by the manhole cover, wherein the slot extends parallel to a length dimension of the shaft portion, wherein the slot extends from a top surface of the manhole cover to an annular slot defined by the manhole cover, and wherein the plate is inserted by the extraction tool in the slot until the plate reaches the annular slot where the plate is rotated into the annular slot to lock the latch bolt in the removal position.

9. The apparatus of claim 7 wherein the extraction tool when locked to the manhole cover may be used to lift the manhole cover off the manhole frame.

10. The apparatus of claim 1, further comprising:

a debris cap attached over an access hole defined by the manhole cover, wherein access to the security bolt and a hole configured to receive the extraction tool is prevented.

11. An apparatus, comprising:

a manhole cover having at least one lug that is configured to be received by a manhole frame;

a latch bolt received in a first bore defined by the manhole cover extends horizontally from a periphery of the manhole cover toward a center thereof, the latch bolt movable between a latched position and a removal position, wherein in the latched position a protrusion extends radially outwardly from the periphery to a location spaced from and below the manhole frame;

a spring disposed in the first bore biases the latch bolt toward the latched position;

a security bolt received in a second bore defined by the manhole cover that extends substantially vertically through the manhole cover, wherein the security bolt is received in an opening defined by the latch bolt to lock the latch bolt in the locked position; and a third bore defined by the manhole cover extends from a top surface of the manhole cover at a substantially acute angle of about 45 degrees from the top surface to the second bore, and wherein the latch bolt defines a recess having a cam surface at an intermediate location on the latch bolt, the recess being configured to be engaged by a distal end of an extraction tool, wherein the extraction tool engages the cam surface to move the latch bolt toward the spring when the security bolt is removed from the opening defined by the latch bolt.

12. The apparatus of claim 11 wherein the latch bolt is spaced below the manhole frame in the latched position, wherein when a fluid applies pressure to a lower surface of the manhole cover sufficient to lift the manhole relative to the manhole frame, a space is created between a periphery of the manhole cover and the manhole frame that vents the fluid.

13. The apparatus of claim 12 wherein the fluid is an expanding gas created by a first explosion, and wherein the manhole cover drops back onto the manhole frame after the expanding gas is vented to prevent a second explosion caused by air flowing back under the manhole cover into a vacuum created by the first explosion.

14. The apparatus of claim 11 wherein the latch bolt defines a guide slot adjacent a hole in a top surface of the latch bolt that guides movement of the latch bolt between the latched position and the removal position and prevents rotation of the latch bolt.

15. The apparatus of claim 11, further comprising:

an extraction tool including an elongated shaft, a handle on an upper end, and a drive cam surface on a lower end.

16. The apparatus of claim 15 wherein a twist lock mechanism locks the extraction tool to the manhole cover when fully inserted into a bore defined by the manhole cover and the latch bolt is in the removal position.

17. The apparatus of claim 16 wherein the twist lock mechanism includes a plate provided on a shaft portion of the extraction tool, wherein the plate is inserted into at least one slot defined by the manhole cover, wherein the slot extends parallel to a length dimension of the shaft portion, wherein the slot extends from the top surface of the manhole cover to a seat that is defined by an annular slot formed in the manhole cover, and wherein the plate is inserted by the extraction tool in the slot until the plate reaches the annular slot where the plate is rotated into the annular slot to lock the latch bolt in the removal position.

18. The apparatus of claim 16 wherein the extraction tool when locked to the manhole cover may be used to lift the manhole cover off the manhole frame.

19. The apparatus of claim 11, further comprising:

a debris cap attached over an access hole defined by the manhole cover, wherein access to the security bolt and a hole configured to receive the extraction tool is prevented.

20. The apparatus of claim 11 wherein the security bolt is adapted to be turned by a tool inserted through the second bore.

* * * * *